US009089890B2

(12) United States Patent
Auchter et al.

(10) Patent No.: US 9,089,890 B2
(45) Date of Patent: Jul. 28, 2015

(54) METHOD FOR THE PRODUCTION OF A HEAT EXCHANGER

(75) Inventors: Holger Auchter, Stuttgart (DE); Hans-Peter Heuss, Korntal-Münchingen (DE); Bruno Lösch, Böblingen (DE)

(73) Assignee: MAHLE Behr GmbH & Co. KG, Stuttgart (DE)

( * ) Notice: Subject to any disclaimer, the term of this patent is extended or adjusted under 35 U.S.C. 154(b) by 2549 days.

(21) Appl. No.: 11/791,991

(22) PCT Filed: Dec. 5, 2005

(86) PCT No.: PCT/EP2005/013010

§ 371 (c)(1),
(2), (4) Date: Jun. 26, 2007

(87) PCT Pub. No.: WO2006/058792

PCT Pub. Date: Jun. 8, 2006

(65) Prior Publication Data

US 2008/0121388 A1 May 29, 2008

(30) Foreign Application Priority Data

Dec. 3, 2004 (DE) ..... 10 2004 058 574
Apr. 19, 2005 (DE) ..... 10 2005 018 187

(51) Int. Cl.

| | |
|---|---|
| ***F28F 9/02*** | (2006.01) |
| ***B21D 28/24*** | (2006.01) |
| ***B21D 53/08*** | (2006.01) |
| *F28D 7/06* | (2006.01) |

(52) U.S. Cl.

CPC ..... *B21D 28/24* (2013.01); *B21D 53/08* (2013.01); *F28F 9/02* (2013.01); *F28F 9/0207* (2013.01); *Y10T 29/4935* (2015.01); *Y10T 29/49833* (2015.01)

(58) Field of Classification Search

CPC .. B21D 28/24; B21D 53/08; Y10T 29/49833; Y10T 29/4935; F28F 9/02; F28F 9/0207

USPC ..... 165/173, 175, 176, 148, 153; 29/890.038, 890.043, 890.052

See application file for complete search history.

(56) References Cited

U.S. PATENT DOCUMENTS

| | | | | | |
|---|---|---|---|---|---|
| 3,021,804 | A | * | 2/1962 | Simpelaar | 29/890.046 |
| 3,245,465 | A | * | 4/1966 | Young | 165/148 |
| 4,150,556 | A | | 4/1979 | Melnyk | |
| 4,234,041 | A | * | 11/1980 | Melnyk | 165/173 |
| 4,400,965 | A | * | 8/1983 | Schey | 72/334 |
| 4,881,594 | A | * | 11/1989 | Beamer et al. | 165/173 |
| 5,092,397 | A | * | 3/1992 | Fuhrmann et al. | 165/151 |

(Continued)

FOREIGN PATENT DOCUMENTS

| | | | |
|---|---|---|---|
| DE | 33 16 960 | A1 | 11/1983 |
| DE | 102 37 769 | A1 | 2/2004 |

(Continued)

*Primary Examiner* — Tho V Duong
(74) *Attorney, Agent, or Firm* — Muncy, Geissler, Olds & Lowe, P.C.

(57) ABSTRACT

A method for the production of a receiving device for the flow tubes of a heat exchanger with openings for receiving the flow tubes. One opening is at least partially produced by a first forming method and at least partially by a second forming method that is different from the first.

13 Claims, 10 Drawing Sheets

(56) References Cited

U.S. PATENT DOCUMENTS

| | | | | |
|---|---|---|---|---|
| 5,243,842 | A | 9/1993 | Kobayashi et al. | |
| 5,327,959 | A * | 7/1994 | Saperstein et al. | 165/173 |
| 5,605,191 | A * | 2/1997 | Eto et al. | 165/176 |
| 6,082,439 | A | 7/2000 | Kato et al. | |
| 6,202,741 | B1 * | 3/2001 | Demuth et al. | 165/176 |
| 6,446,337 | B1 * | 9/2002 | Halm et al. | 29/890.052 |
| 6,651,333 | B2 * | 11/2003 | Letrange et al. | 29/890.052 |
| 6,932,152 | B2 * | 8/2005 | Iwasaki et al. | 165/83 |
| 6,971,445 | B2 | 12/2005 | Lamich et al. | |
| 2004/0111886 | A1 | 6/2004 | Wenger et al. | |

FOREIGN PATENT DOCUMENTS

| | | | |
|---|---|---|---|
| EP | 656517 | A1 * | 6/1995 |
| FR | 2 780 153 | A1 | 12/1999 |
| GB | 169855 | | 10/1921 |
| JP | 8-254399 | | 10/1996 |
| JP | 10-160385 | | 6/1998 |
| JP | 11-051592 | A | 2/1999 |

* cited by examiner

METHOD FOR THE PRODUCTION OF A HEAT EXCHANGER

FIELD OF THE INVENTION

The present invention relates to a method for the production of a heat exchanger. The method is described in terms of a heat exchanger which is used in motor vehicles, for example in air-conditioning systems of a motor vehicle and the like. The method can however also be applied to other heat exchangers.

BACKGROUND OF THE INVENTION

Heat exchangers of said type conventionally have a plurality of throughflow tubes, through which a refrigerant is conveyed. Said throughflow tubes open out into tube plates which are conventionally arranged at the ends of the tubes.

For this purpose, the tube plates have openings into which or through which the throughflow tubes can be inserted. Several production methods are known from the prior art for producing said openings, which are referred to in the following as rim holes. Said rim holes can for example be generated by punching or else by means of tearing processes such as lancing or the like.

While, in the case of punching, the opening is generated by means of a shearing process, in a tearing process, the material to be machined is expanded and torn apart.

The advantages of a punching process are that the production is relatively simple, the opening or rim hole produced in such a way has a high degree of accuracy and any cross-sectional shape can be produced. If lancing is used as a production method from the solid sheet metal material, then it is possible in this way to generate funnel-shaped insertion bevels of the rim hole, and thereby to obtain facilitated assembly and soldering processes. In this case, a solder coating is additionally obtained in the contact or connecting region between the throughflow tube and the rim hole when using solder-coated metal starting sheets.

Finally, a larger possible contact area between the throughflow tubes and the rim holes or openings is generated than in the case of punched rim holes, since the latter can corresponding at most to the metal sheet thickness of the base or of the collector.

SUMMARY OF THE INVENTION

The object of the invention is that of utilizing the advantages of both methods in the production.

In the method according to the invention for the production of a holding device for throughflow tubes of a heat exchanger having openings for holding the throughflow tubes, at least one opening is generated partially by means of a first shaping process and at least partially by means of a second shaping process which is different from the first shaping process.

A shaping process is to be understood to mean any methods are suitable for imparting a predefined shape to a base material such as for example a base metal sheet, such as for example for generating an opening or a rim hole in the base material.

A holding device is to be understood to mean a device which holds at least one region of the throughflow tubes, for example their end regions, which are inserted into the openings of the holding device.

The first shaping process is preferably a punching process and the second shaping process is preferably a tearing process.

Here, as illustrated above, a punching process is to be understood to mean a process in which the opening is generated by means of a shearing process. A tearing process is to be understood to mean a process in which the opening is generated at least at times by means of drawing or tearing.

An at least partial generation of the opening by means of the one and the other process is to be understood to mean that certain regions of the opening are generated by means of the one shaping process, such as for example punching, and other regions of the opening are generated by means of the further shaping process, that is to say in particular tearing.

A further possibility is to use both shaping processes on predefined regions of the opening which is to be generated.

Here, those regions of the openings which have particularly complex cross-sectional shapes, such as for example central regions with a very small width, are generated by means of the punching process, while other regions are generated by means of the tearing process.

The first shaping process and the second shaping process preferably take place at substantially the same time. It is possible here for the two processes to be carried out in one working step.

It is preferably also possible for the first shaping process and the second shaping process to take place in separate process steps. It is possible here for punching to initially take place, and subsequently for a tearing process to be used; it is however also possible for the tearing process to initially be used and subsequently for a punching process to be carried out.

The present invention is also aimed at a method for the production of a heat exchanger, wherein, in one method step during the production, a holding device is carried out according to an above-described method, and the throughflow tubes are subsequently connected at least in sections to the holding device by a connecting means.

Here, the connecting means is preferably solder or the like. It is possible here for the connecting means to be applied after the production of the rim hole. It is however preferably also possible for initially solder-coated metal sheets to be used. In this case, solder-coated edges are generated as a result of the above-described process, in particular the tearing process. Said edges or collars are generated, in particular but not exclusively, in the form of insertion bevels, by means of which the assembly and/or soldering processes are facilitated.

In addition, as mentioned above, the collar serves to increase the contact area between the rim holes and the throughflow tubes, which likewise facilitates the production, in particular the soldering processes, and provides a higher degree of impermeability of the end products.

The invention is also aimed at a holding device for throughflow tubes of a heat exchanger, which holding device has a plurality of openings which are suitable for holding the throughflow tubes, with the openings being arranged substantially in a predefined main plane of the holding device and having a predefined circumference. Here, according to the invention, the openings have, in at least one region, a border which protrudes from the main plane and, in at least one region of the circumference, substantially do not protrude from the main plane.

A border is to be understood here, in particular but not exclusively, as a collar which is arranged around the circumference.

The main plane is to be understood to mean a geometric plane in which the individual openings are arranged. In one embodiment, the plane can for example be formed by the metal sheet, which is to be machined, itself. It is however also possible for the tube plate to have a base plane which is arranged laterally offset relative to the main plane in which the openings are arranged.

Regions which substantially do not protrude from the main plane are to be understood in the following to mean regions without borders or collars. Here, "without borders" or "without collars" does not exclusively mean that no elevations beyond the main plane may be present.

In a further preferred embodiment, the borders point from the main plane in substantially the direction of the ends of the throughflow tubes. This means that the throughflow tubes are inserted through the openings, and the borders project from the main plane in the same direction in which the throughflow tubes are inserted through the openings.

The borders can however also, as mentioned above, run obliquely with respect to the main plane and form insertion bevels which facilitate the assembly, in particular the connection to the throughflow tubes.

In a further preferred embodiment, the borders protrude substantially perpendicularly from the main plane. Here, the borders protrude between 0.3 mm and 3.0 mm, preferably between 0.5 mm and 2.0 mm and particularly preferably between 0.5 mm and 1.0 mm from the plane. Said protrusions are co-determined here by the width of the opening which is to be generated.

In a further preferred embodiment, the openings have an elongate shape. "Elongate" is to be understood to mean that the opening has a predefined length and a width which is considerably reduced in relation to said length. The reason for this is that the throughflow tubes are conventionally flat tubes whose ends likewise have an elongate cross section.

In a further preferred embodiment, the openings substantially do not protrude from the main plane in their end regions. This means that for example a gap or the like is provided or generated in the end region.

In a further preferred embodiment, the openings have a central region with a reduced width. The central regions of the throughflow tubes are inserted through said central region. Said central region are narrowed in their width in order to divide the throughflow tube into two regions in which flow preferably passes in different flow directions in each case.

The openings preferably substantially do not protrude from the main plane in the central regions. This means that no borders or collars are provided in the central region.

The reason for this is that the central regions have a reduced width, and therefore the production is carried out by means of a more precise method such as, in particular but not exclusively, punching, which generates substantially no borders.

In a further preferred embodiment, the main plane is arranged so as to be offset parallel relative to the base plane of the holding device. Here, the main plane is preferably arranged closer than the base plane to the end of the throughflow tubes. This means that the throughflow tubes protrude geometrically through both the base plane and the main plane.

The invention is also aimed at a heat-exchanging device having a plurality of throughflow tubes which are suitable for transporting a refrigerant, with a holding device of the above-described type being arranged on at least one end section of the throughflow tubes. It is preferable for in each case one holding device of the above-described type to be arranged on both end sections of the throughflow tubes. Here, the device preferably has a partition which is arranged perpendicularly with respect to the rim holes, thereby providing a division to form two flow regions.

In a further preferred embodiment, the separating device, in particular the partition, is aligned substantially parallel to the passage openings. The separating device is preferably arranged in a holding section which has the guide faces for retaining the separating device.

BRIEF DESCRIPTION OF THE DRAWINGS

Further advantages and embodiments of the present invention can be gathered from the appended drawings.

DETAILED DESCRIPTION

Figure 1:
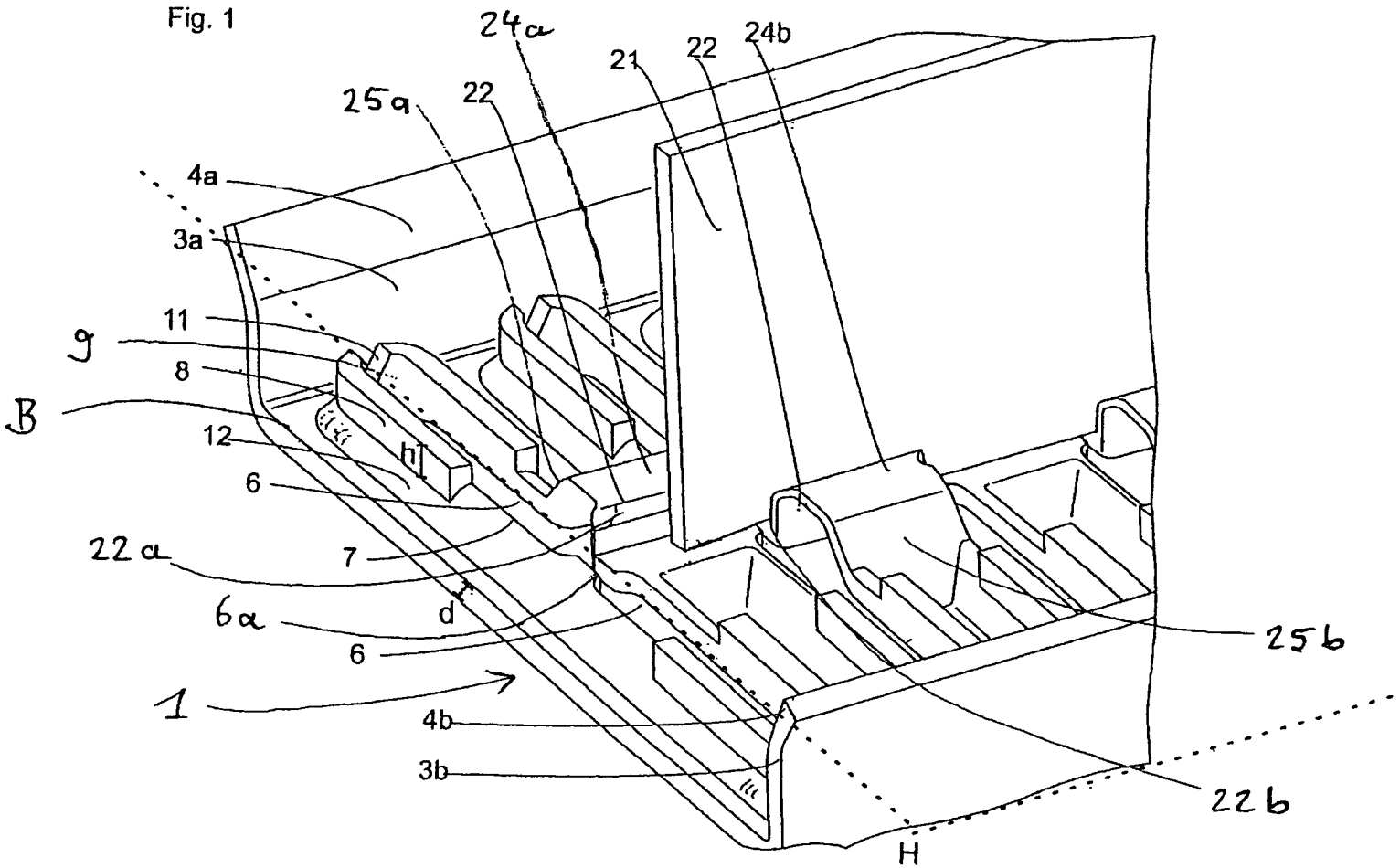
FIG. 1 is a perspective illustration of a holding device according to the invention in detail.

In FIG. 1, the reference symbol 1 relates to a holding device or a tube plate as per the present invention. Said holding device has two side borders 3*a* and 3*b* which serve for connecting to a further device, for example a cover. For this purpose, the side borders can have obliquely-running sections 4*a* and 4*b* which serve for engagement with a cover.

The tube plate has a thickness d which is between 0.2 mm and 3 mm, preferably between 0.5 mm and 2 mm and particularly preferably in the range from 0.5 mm to 1 mm. Provided in the tube plate is a plurality of openings 6. Said openings have an elongate shape and are situated together in a main plane H.

By means of the production method according to the invention, which is composed of a combination of a punching process and a drawing process, in the circumferential region of the openings 6, borders or collars 8 are generated in one region of the circumference, and not in other regions 7.

The main plane H is illustrated in FIG. 1 by the two dashed lines. Situated in said plane are the respective openings 6, more precisely the circumferential borders of the openings 6 in those regions 7 in which there are no collars. Also, in FIG. 1, a partition 21 which will be explained further below is aligned substantially perpendicular to the main plane H.

The transition between the borders 8 and the regions 7 without borders is illustrated here in the manner of a step. The transition can however also be continuous or, in the mathematical sense, differentiable. The borders 8 themselves can also have rounded-off shapes.

The borders 8 are illustrated here with a constant height h, though the height can however also vary in different regions. The height of the borders or collars 8 can also differ from opening 6 to opening 6.

The openings have a central region 6*a* which has a reduced width in relation to the remaining region of the opening. Said narrowed region serves for holding a central region of the throughflow tubes (not shown) which are inserted through the openings 6. Since relatively high demands must be made of the precise cross-sectional shape in this region, this region is produced by means of punching, that is to say there is no circumferential border or collar 8 in this region.

In the end regions 9 of the openings 6, too, there is a gap 11 which is generated as a result of the lancing process. Said gap 11 is also illustrated by rectilinear profile. The gap 11 can however also have curved borders.

In this embodiment, the plane H in which the openings 6 are arranged is laterally offset with respect to a base plane B. The base plane B is to be understood to mean the plane from which the side borders 3*a* and 3*b* extend. Provided from the base plane B toward the openings 6 is a bevel 12. It is however also possible here for the main plane H and the base plane B to substantially geometrically coincide, in the same way as it would be conceivable for the main plane H to be arranged below the base plane B with respect to FIG. 1. In this case, the openings 6 are arranged further away than the base plane B of the holding device 1 from the end sections of the throughflow tubes (not shown).

The reference symbol 21 denotes a partition which separates the respective openings 6 into a left-hand-side region and a right-hand-side region. More precisely, the entire holding device 1 is separated into a left-hand-side region and a right-hand-side region.

Here, said separation can be substantially symmetrical, though embodiments are also possible in which the separation is asymmetrical.

Here, the partition 21 bears in each case alternately against steps 22, more precisely against the sections 22*a* and 22*b* of the steps 22, which run substantially parallel to the plane of the partition. Adjacent thereto, the steps 22 also have sections 24*a* and 24*b* which run substantially perpendicular with respect to the plane of the partition, and sections 25*a* and 25*b* which run obliquely with respect to the plane of the partition 21.

In this embodiment, the partition bears in each case against the narrowed region 6*a* of the openings 6. In addition, the partition 21 can have slots (not shown) which hold the ends of the throughflow tubes (likewise not shown) at least in the region of the opening 6.

As a result of the absence of borders or collars in the regions 6*a* of the openings 6, it is possible for the slots in the partition to also be smaller or more precisely matched, which ultimately leads to an increased degree of impermeability of the respective connections between the throughflow tubes and the partition.

As a result of the use of the partition, the holding device 1 and therefore the cover or the base of the heat-exchanging device is separated into a left-hand-side and a right-hand-side partial region. Said separation is preferably continued further into the throughflow devices (not shown) which are inserted into the holding device.

The production-related difficulty is in the production or configuration of the transition regions of the two processes in the region of the openings or rim holes. Said transition region may not have any large solder gaps after the joining process, that is to say after the insertion of the throughflow tubes into the openings, in order not to adversely affect the subsequent soldering process and to prevent the occurrence of leakages after assembly.

For this purpose, coordinated tools are used for the individual shaping processes, that is to say, in particular but not exclusively, for the punching and tearing processes, such as for example coordinated punches and dies.

Here, the tools are preferably selected so as to have an overlapping region between those regions in which the respective processes are applied, that is to say that in the transition regions, the material is machined by both processes or by both tools.

It is for example possible by means of suitable dimensioning of the tools to provide that, in the case in which initially a punching process and subsequently a tearing process are carried out, the already-punched regions of the openings are not subjected to any further forces, which lead to a deformation of the already-punched material, by the tearing process.

Figure 2:
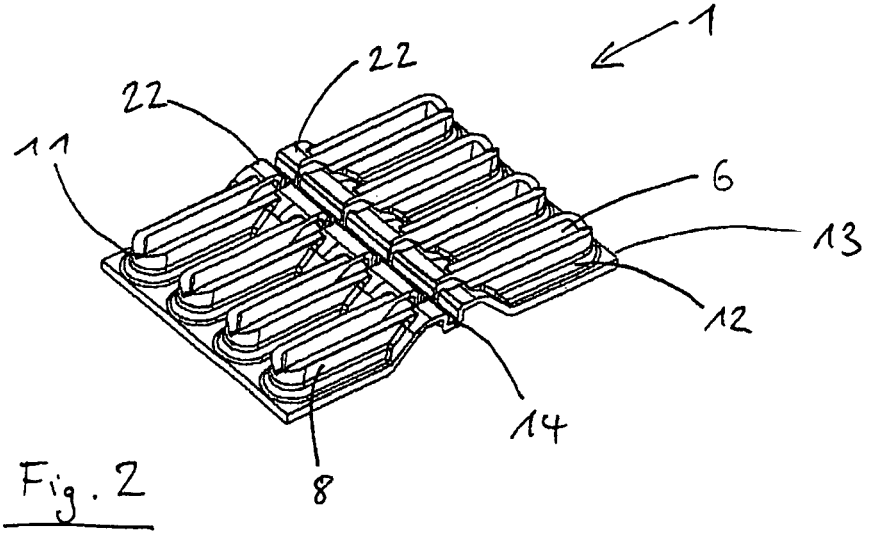
FIG. 2 is a perspective illustration of the base device according to the invention in a further embodiment.

FIG. 2 shows a further embodiment of the base device 1 of the heat-exchanging device according to the invention in a perspective view from above. The base device 1 has rim holes 6 which are surrounded by collars 8. Here, the collars 8 are connected by means of bevels 12 to a base 13 of the base device 1. Illustrated approximately centrally and transversely with respect to the rim holes 6 for holding corresponding flat tubes (not illustrated) is a base section 14 with steps 22, which are situated opposite one another, for holding the partition 21. Arranged at the outer ends of the collars of the rim holes 6 is in each case one gap. The rim holes 6 with the collars 8 and the gap 11 can be generated by means of a combined tearing and punching process as described above.

Figure 3:
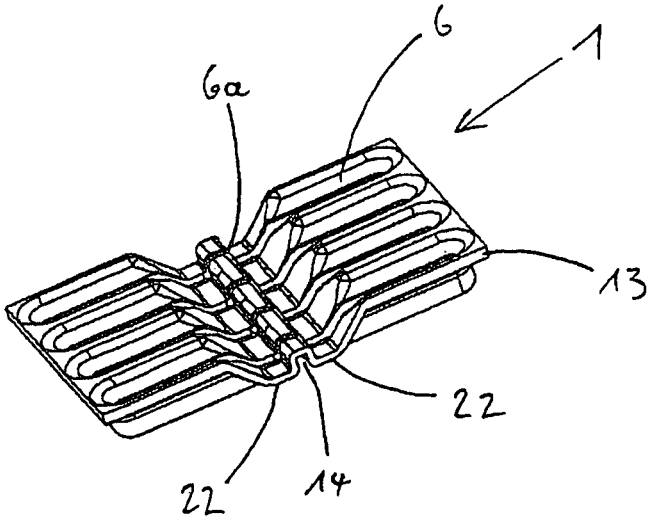
FIG. 3 is a rear view of the further embodiment of the base device according to the invention.

FIG. 3 shows the base device 1 of FIG. 2 from below, that is to say in a rear view. In addition to the rim holes 6 and the base section 14 with the steps 22 are the narrowed central regions 6*a* of the rim holes 6.

Figure 4:
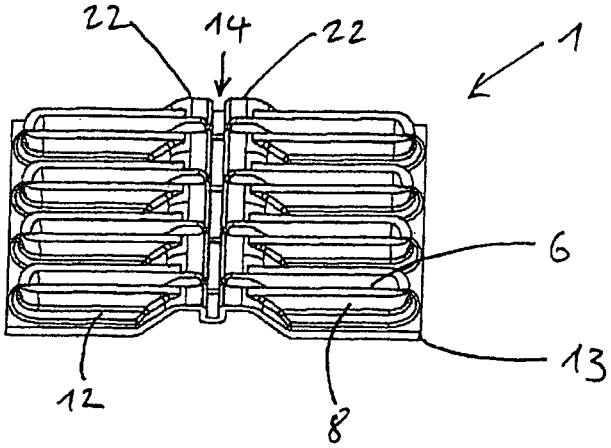
FIG. 4 is a further illustration of the base device according to the invention as per FIG. 2.
Figure 5:
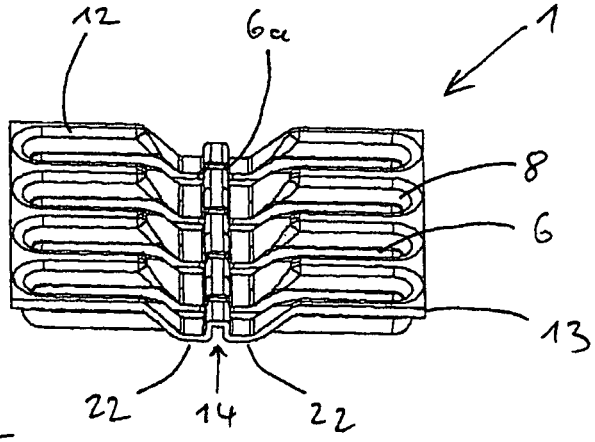
FIG. 5 is a rear view of a further embodiment of the base device according to the invention as per FIG. 2.

FIG. 4 and FIG. 5 correspond to FIGS. 2 and 3, in a further perspective view. For explanation, reference is therefore made to the preceding description of FIGS. 2 and 3.

Figure 6:
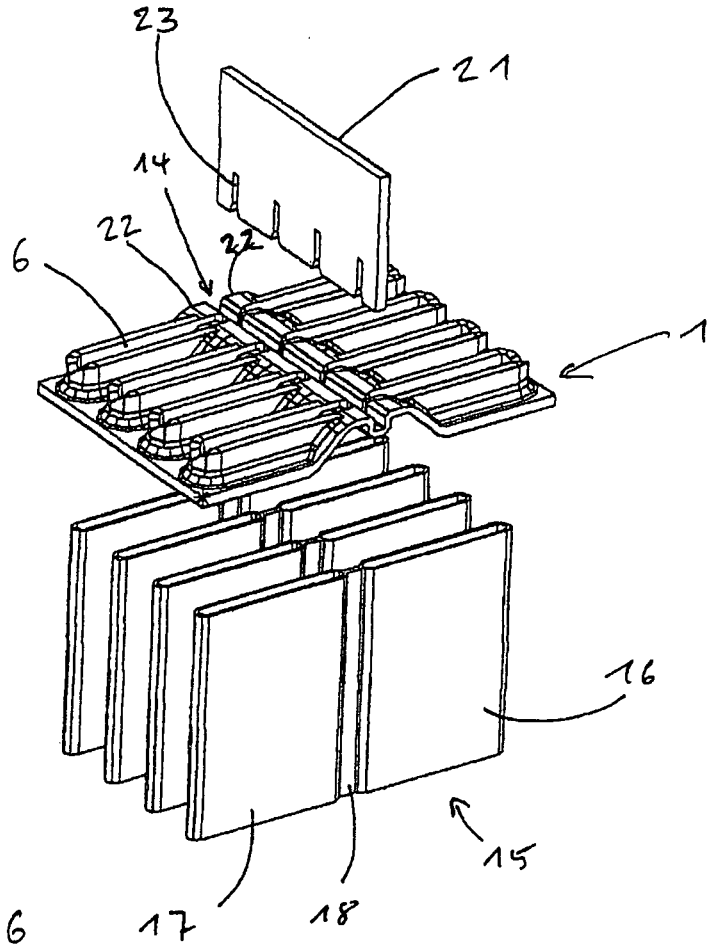
FIG. 6 is an exploded illustration of the heat-exchanging device according to the invention.

FIG. 6 shows the heat-exchanging device according to the invention using the base device of FIG. 2. Flat tubes or throughflow devices 15 having flow chambers 16 and 17 and a narrowed region 18, which separates the flow chambers 16, 17 from one another, are inserted into the base device 1 through the rim holes 6 with their narrowed central regions 61. A partition 21 with slots 23 is inserted into the base section 14, which partition serves to separate the flow into two regions. Here, the partition 21 is supported by the steps 22. The slots 23 of the partition 21 serve to hold the narrowed regions 18 of the flat tubes 15.

Figure 7:
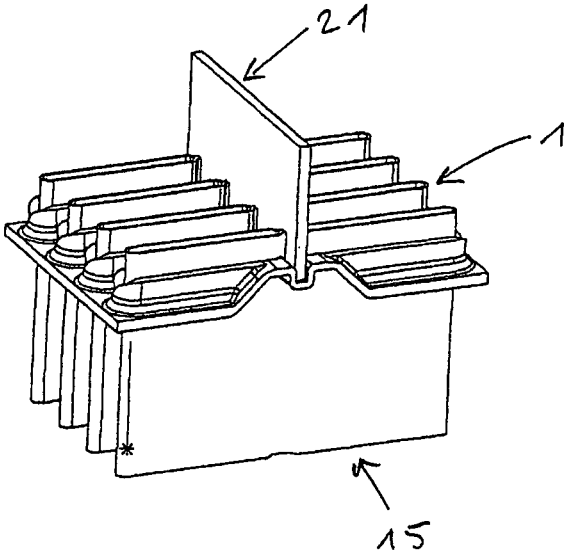
FIG. 7 is an illustration of the device as per FIG. 6.

FIG. 7 shows the device as per FIG. 6 composed of the base device 1, a plurality of inserted flat tubes and a partition 21.

Figure 8:
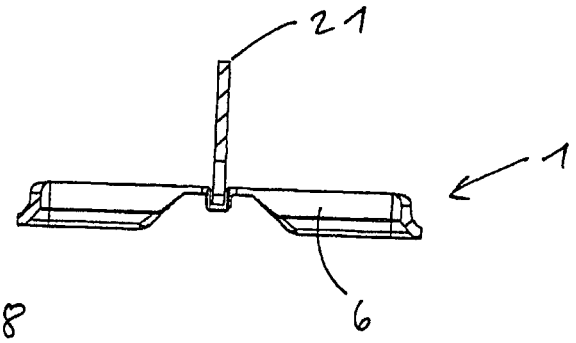
FIG. 8 shows a cross section of the base device of FIG. 6 transversely with respect to the partition along a partition slot.

FIG. 8 shows a section perpendicularly with respect to the inserted partition 21 through the base device 1 of FIG. 2, with the section running through a slot 23 of the partition 21 and therefore along a rim hole 6.

Figure 9:
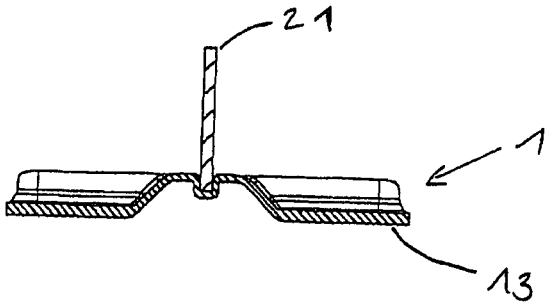
FIG. 9 shows a cross section of the base device of FIG. 6 transversely with respect to the non-slotted partition.

FIG. 9 shows a further section perpendicularly with respect to the inserted partition 21 through the base device 1 of FIG. 2, with the section running through a region of the partition 21 without a slot, and therefore not along a rim hole 6, such that the base 13 of the base device 1 can be seen.

Figure 10:
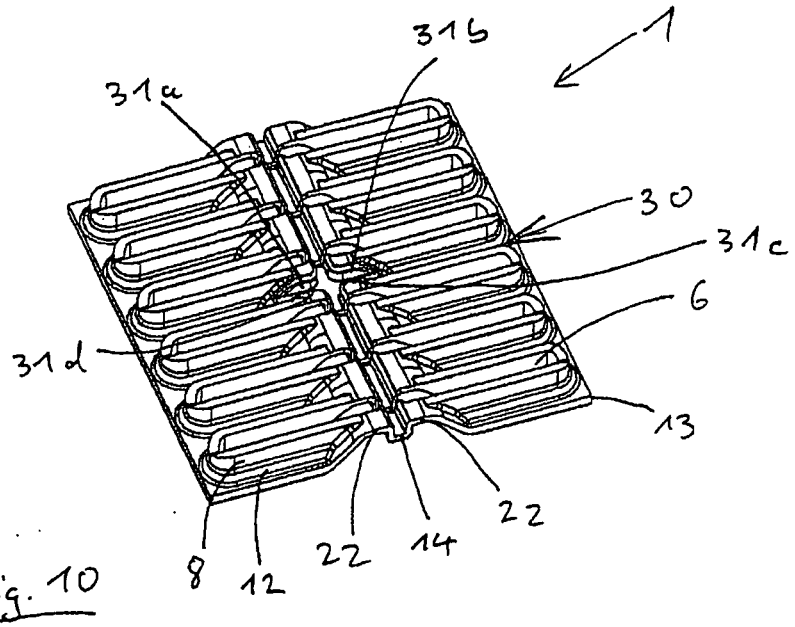
FIG. 10 is a perspective illustration of the base device according to the invention in a further embodiment.

FIG. 10 shows a further embodiment of a base device 1 having rim holes 6 which are surrounded by collars 8 which are arranged on bevels 12, with the bevels 12 producing the connection to the base 13 of the base device 1. Similarly to the base device of FIG. 2, a base section 14 which runs substantially perpendicular to the rim holes 5 and has steps 22, which are arranged opposite one another, is provided, which base section 14 serves to hold a partition (not illustrated). In contrast to the embodiment of FIG. 2, a further holding section 30, which runs perpendicular to the base section 14, is provided, which holding section 30 has guide faces 31*a*, 31*b*, 31*c* and 31*d* which stand perpendicular to the plane of the base device 1. By means of the holding section 30 and the guide faces 31*a*, 31*b*, 31*c* and 31*d*, it is possible for a partition to be inserted into the base device 1, which partition is arranged parallel to the rim holes 6. If a further partition of corresponding configuration is likewise to be inserted into the base section 14 which is provided for holding a partition, then it is possible for the flow to be divided into four. The arrangement of two holding devices for partitions, specifically the base section 14 and the holding section 30, otherwise opens up the possibility of the arrangement of a partition perpendicular or parallel to the rim holes 6.

Figure 11:
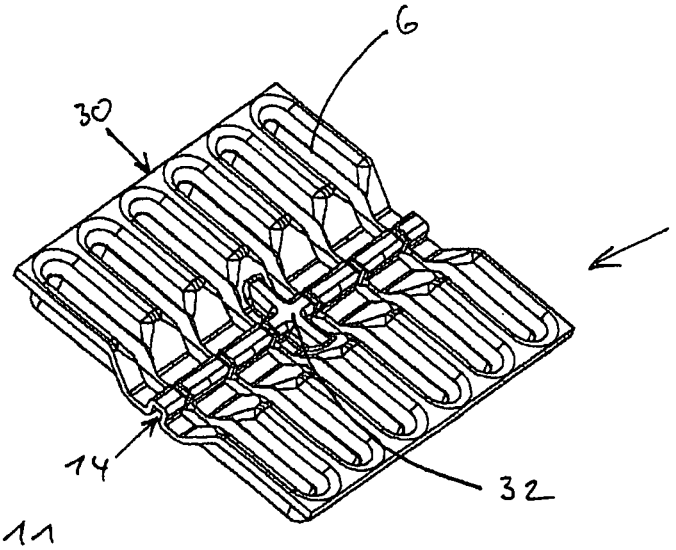
FIG. 11 shows a rear view of the further embodiment of the base device according to the invention.

FIG. 11 shows the base device 1 of FIG. 10 in a rear view. It can be seen that, in the rear view, the intersection of the two holding sections 14 and 30 is in the shape of a cross 32.

Figure 12:
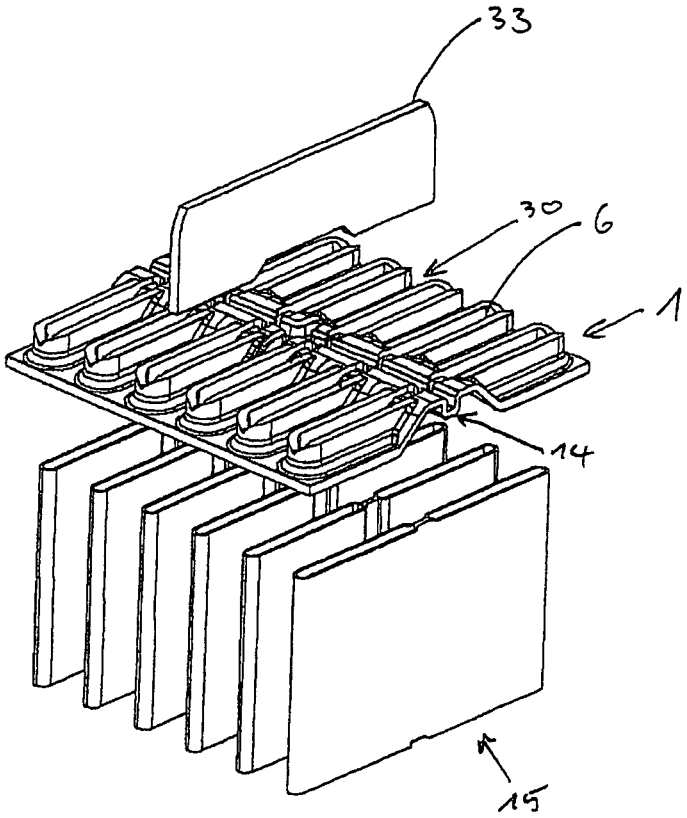
FIG. 12 is an exploded illustration of the further embodiment of the heat-exchanging device according to the invention.

FIG. 12 is an exploded illustration of an embodiment of the heat-exchanging device according to the invention having a base device 1 as per FIG. 10, a further partition 33 and a plurality of flat tubes 15. The further partition 33 runs in the direction of the elongate rim holes 6 and leads to a separation of the flow into two regions if only said further partition 33 is used. If a corresponding "first" partition 21 (not illustrated) is additionally inserted into the base section 14, then the flow is divided into four.

Figure 13:
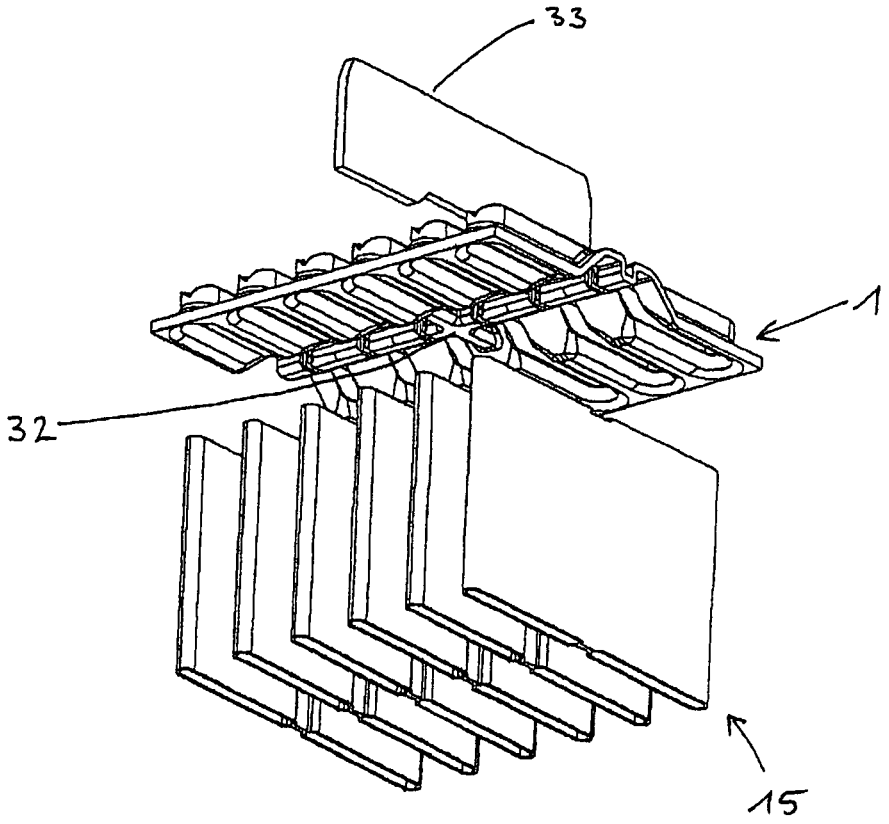
FIG. 13 is an exploded illustration of the further embodiment of the heat-exchanging device according to the invention in a rear view.

FIG. 13 is an exploded illustration, in a rear view, of the embodiment of the heat-exchanging device according to the invention of FIG. 12 having a base device 1 as per FIG. 10, a further partition 33 and a plurality of flat tubes 15. It is possible to see the cross 32 which is arranged approximately centrally in the base device 1, so that a partition can be inserted which runs either in the direction perpendicular or in the direction parallel to the rim holes 6.

Figure 14:
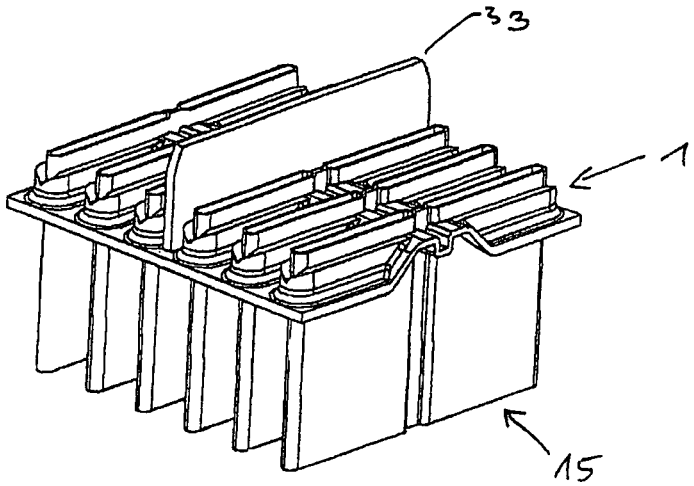
FIG. 14 is a perspective illustration of the further embodiment of the heat-exchanging device.

FIG. 14 shows the heat-exchanging device as per FIG. 28 in the assembled state having a partition 31, a base device 1 and a plurality of flat tubes 40.

Figure 15:
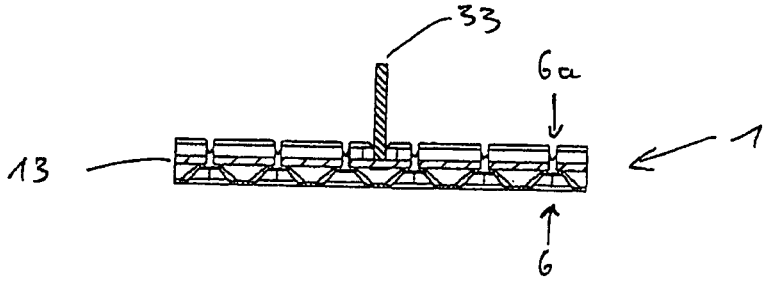
FIG. 15 shows a cross section through the base device of the device as per FIG. 14.

FIG. 15 finally shows a cross section through a base device 1 which is provided with a further partition 33 along the base section 14 of FIG. 10, such that the narrowed regions 6*a* of the rim holes 6 can be seen in the base 13.

The invention claimed is:

1. A holding device for throughflow tubes of a heat exchanger having a plurality of openings which are suitable for holding the throughflow tubes, with the openings being arranged substantially in a predefined main plane of the holding device and having a predefined circumference, wherein the openings have, in at least one region of the circumference, a protruding border which protrudes from the main plane and, in at least one region of the circumference, a non-protruding border that substantially does not protrude from the main plane, the protruding border including a tear in a middle portion thereof.

2. The holding device as claimed in claim 1, wherein the border protrudes from the main plane in substantially the direction of the ends of the throughflow tubes.

3. The holding device as claimed in claim 1, wherein the border protrudes substantially perpendicularly from the main plane.

4. The holding device as claimed in claim 1, wherein the border protrudes between 0.3 mm and 3.0 mm from the plane.

5. The holding device as claimed in claim 1, wherein the openings have an elongate shape.

6. The holding device as claimed in claim 1, wherein the openings substantially do not protrude from the main plane in their end regions.

7. The holding device as claimed in claim 1, wherein the openings have a central region with a reduced width.

8. The holding device as claimed in claim 1, wherein the openings substantially do not protrude from the main plane in a central region.

9. The holding device as claimed in claim 1, wherein the main plane is arranged so as to be offset parallel relative to a base plane of the holding device.

10. The holding device as claimed in claim 9, wherein the main plane is arranged closer than the base plane to the end of the throughflow tubes.

11. The holding device as claimed in claim 1, wherein the border protrudes between 0.5 mm and 2.0 mm from the plane.

12. The holding device as claimed in claim 1, wherein the border protrudes between 0.5 mm and 1.0 mm from the plane.

13. A holding device for throughflow tubes of a heat exchanger having a plurality of openings which are suitable for holding the throughflow tubes, with the openings being arranged substantially in a predefined main plane of the holding device and having a predefined circumference, wherein a first region of the circumference includes a bent border bent away from the main plane, the bent border including a tear in a middle portion thereof, and a second region of the circumference includes a border lying substantially in the main plane.

* * * * *